US005535552A

United States Patent [19]

Stern

[11] Patent Number: 5,535,552

[45] Date of Patent: Jul. 16, 1996

[54] PRESSURE-FIT GATE

[75] Inventor: Carl M. Stern, Pennington, N.J.

[73] Assignee: Innova Development Corporation, Pennington, N.J.

[21] Appl. No.: 334,315

[22] Filed: Nov. 2, 1994

[51] Int. Cl.[6] ..... E05C 21/02

[52] U.S. Cl. ..... 49/465; 49/55; 49/57; 160/225

[58] Field of Search ..... 49/465, 466, 463, 49/50, 55, 57; 160/225, 224, 216, 222

[56] References Cited

U.S. PATENT DOCUMENTS

| | | | |
|---|---|---|---|
| 903,564 | 11/1908 | Haben . | |
| 1,683,204 | 9/1928 | Mills | 160/225 |
| 2,262,800 | 11/1941 | Farmer | 20/71 |
| 2,559,066 | 7/1951 | Diefenbronn | 20/71 |
| 2,577,034 | 12/1951 | Quinlan | 160/217 |
| 2,581,857 | 1/1952 | Harrison | 160/217 |
| 2,756,469 | 7/1956 | Cattermole et al. | 20/71 |
| 2,851,746 | 9/1958 | McPhaden | 20/71 |
| 2,896,277 | 7/1959 | Halligan | 20/71 |
| 2,928,146 | 3/1960 | Kuniholm | 20/71 |
| 2,982,353 | 5/1961 | Luger | 160/183 |
| 3,163,205 | 12/1964 | Gottlieb | 160/216 |
| 3,431,966 | 3/1969 | Injeski | 160/225 |
| 3,489,201 | 1/1970 | Curry, III et al. | 160/225 |
| 3,680,260 | 8/1972 | Bauer | 49/465 |
| 4,492,263 | 1/1985 | Gebhard | 160/228 |
| 4,607,455 | 8/1986 | Bluem et al. | 49/55 |
| 4,787,174 | 11/1988 | Brown | 49/55 |
| 4,846,246 | 7/1989 | Stern | 160/224 |
| 4,944,117 | 7/1990 | Gebhard et al. | 49/55 |
| 5,052,461 | 10/1991 | Stern | 160/224 |
| 5,272,840 | 12/1993 | Knoedler et al. | 49/463 |
| 5,367,829 | 11/1994 | Crossley et al. | 49/465 |
| 5,442,881 | 8/1995 | Asbach et al. | 49/465 |

FOREIGN PATENT DOCUMENTS 494852 1/1953 Canada .

*Primary Examiner*—Philip C. Kannan
*Attorney, Agent, or Firm*—Howrey & Simon; C. Scott Talbot; Leo J. Jennings

[57] ABSTRACT

A pressure-fit barrier such as a gate has a first panel member coupled to a partially overlapping second panel member so that the panels are slidable laterally relative to each other, thus changing the overall width of the gate. A carriage member is slidably mounted on the second panel for lateral movement relative to the second panel and a displacing mechanism is coupled with the carriage member and the second panel and is selectively operable to laterally displace the carriage relative to the second panel. An engagement mechanism is connected to the carriage for selectively engaging with and non-engaging with the first panel. When the engaging mechanism is non-engaged lateral movement of the carriage member with respect to the second panel does not cause relative lateral movement between the first panel and the second panel, and when the engaging mechanism is engaged lateral movement of the carriage member causes corresponding relative lateral movement between the first panel and the second panel. The expansion mechanism may include an over-center linkage.

16 Claims, 4 Drawing Sheets

PRESSURE-FIT GATE

BACKGROUND OF THE INVENTION

The invention relates generally to a barrier such as a safety gate that is removably insertable into an opening such as a doorway. Such gates are used, for example, to prevent an infant, a child or a pet from passing through the doorway. More specifically, the invention relates to an adjustable width, pressure-fit gate that is frictionally retained in the doorway opening by application of outward lateral force to the sides of the opening.

Various types of adjustable-width pressure-fit gates are known. For example, the gate disclosed in U.S. Pat. No. 2,851,746 to McPhaden includes upper and lower cross-members that each have a pivoting toggle portion so that the gate length is shortened when the toggles are raised and the gate length is extended when the toggles are depressed. U.S. Pat. No. 2,756,469 to Cattermole et al. depicts a gate in which the upper and lower cross members have plungers telescoping out from one end. A pivoting lever handle has gear teeth that engage a rack on the plungers to extend the plungers to expand the gate for pressure fit. U.S. Pat. No. 2,928,146 to Kuniholm discloses an expandable gate featuring a lever link arrangement that extends upper and lower plungers to pressure-fit the gate. In each of these gates, the overall unexpanded gate width can be adjusted and set across a range of widths to correspond to the doorway opening width. The toggle or lever is then activated to expand the overall width of the gate to pressure-fit it into the opening by application of lateral force to the sides of the doorway.

However, in each of the gates described in the McPhaden, Cattermole et al., and Kuniholm patents, adjusting the width of the gate to fit the doorway opening width requires the user to make two separate adjustments—both upper and lower. In McPhaden and Cattermole et al., the user must tighten both upper and lower locking bolts to adjust and set the width of the gate. In Kuniholm, the user must adjust upper and lower threaded plungers. Thus, the user is required to adjust and set the gate width in two places.

In addition, each of these designs in the McPhaden, Cattermole et al., and Kuniholm patents require both upper and lower lever arms along the upper and lower cross members of the gate. This duplication of lever mechanisms undesirably increases the complexity of the gate as compared to a gate having a single lever mechanism.

Pressure-fit gates are also known that utilize two generally similar overlapping panels. For example, the gate described in U.S. Pat. No. 3,163,205 to Gottlieb includes two overlapping panels supported between upper and lower cross members. Each cross member includes two telescoping tubes connected by an expansion lever device. The unexpanded gate width is not locked. Rather, the gate panels are moved to a suitable unexpanded width and the upper and lower lever handles are separately activated to separately expand the upper and lower cross members to pressure-fit the gate. Accordingly, this design also suffers from the disadvantage of requiring the user to engage both upper and lower lever handles to pressure-fit the gate.

U.S. Pat. No. 5,052,461 to Stern discloses a gate having overlapping panels where one of the panels features a central squeeze activated handle. Activating the handle retracts or releases spring loaded plungers on the side of the gate to retain the gate in the opening.

U.S. Pat. No. 4,607,455 to Bluem et al. also discloses a gate having overlapping panels. The upper and lower sliders connecting the panels do not lock. Rather, a handle is provided on one of the panels which can be rotated to a position where it does not engage with a rack on the other panel and the panels may be slid freely to adjust the overall width of the gate. When the handle is then rotated, teeth connected to the handle engage the rack and spread the two overlapping sections apart to frictionally retain the gate. This gate suffers from the disadvantage that the unexpanded gate width cannot be conveniently set for repeated use. Accordingly, the user must perform the procedure of adjusting the unexpanded width of the gate before each time the handle is activated. This requirement that the unexpanded width of the gate be readjusted each time the gate is reinstalled requires an extra step on the part of the user as opposed to a gate where the unexpanded width can be selectively fixed for multiple installation and removal procedures.

Accordingly, there is a need for a pressure-fit gate assembly that provides a single adjustment for selectively fixing the unexpanded width of the gate along with a convenient mechanism for expanding the gate for pressure-fit.

SUMMARY OF THE INVENTION

The drawbacks of the prior art are overcome by the method and apparatus of the invention. In one aspect, the invention provides a pressure-fit barrier such as a gate having a first panel member coupled to a partially overlapping second panel member so that the panels are slidable laterally relative to each other, thus changing the overall width of the gate. A carriage member is slidably mounted on the second panel for lateral movement relative to the second panel and a displacing mechanism is coupled with the carriage, member and the second panel and is selectively operable to laterally displace the carriage relative to the second panel. An engagement mechanism is connected to the carriage for selectively engaging with and non-engaging with the first panel. When the engaging mechanism is non-engaged lateral movement of the carriage member with respect to the second panel does not cause relative lateral movement between the first panel and the second panel, and when the engaging mechanism is engaged lateral movement of the carriage member causes corresponding relative lateral movement between the first panel and the second panel. In another aspect, the expansion mechanism may include an over-center linkage.

DETAILED DESCRIPTION

Figure 1:
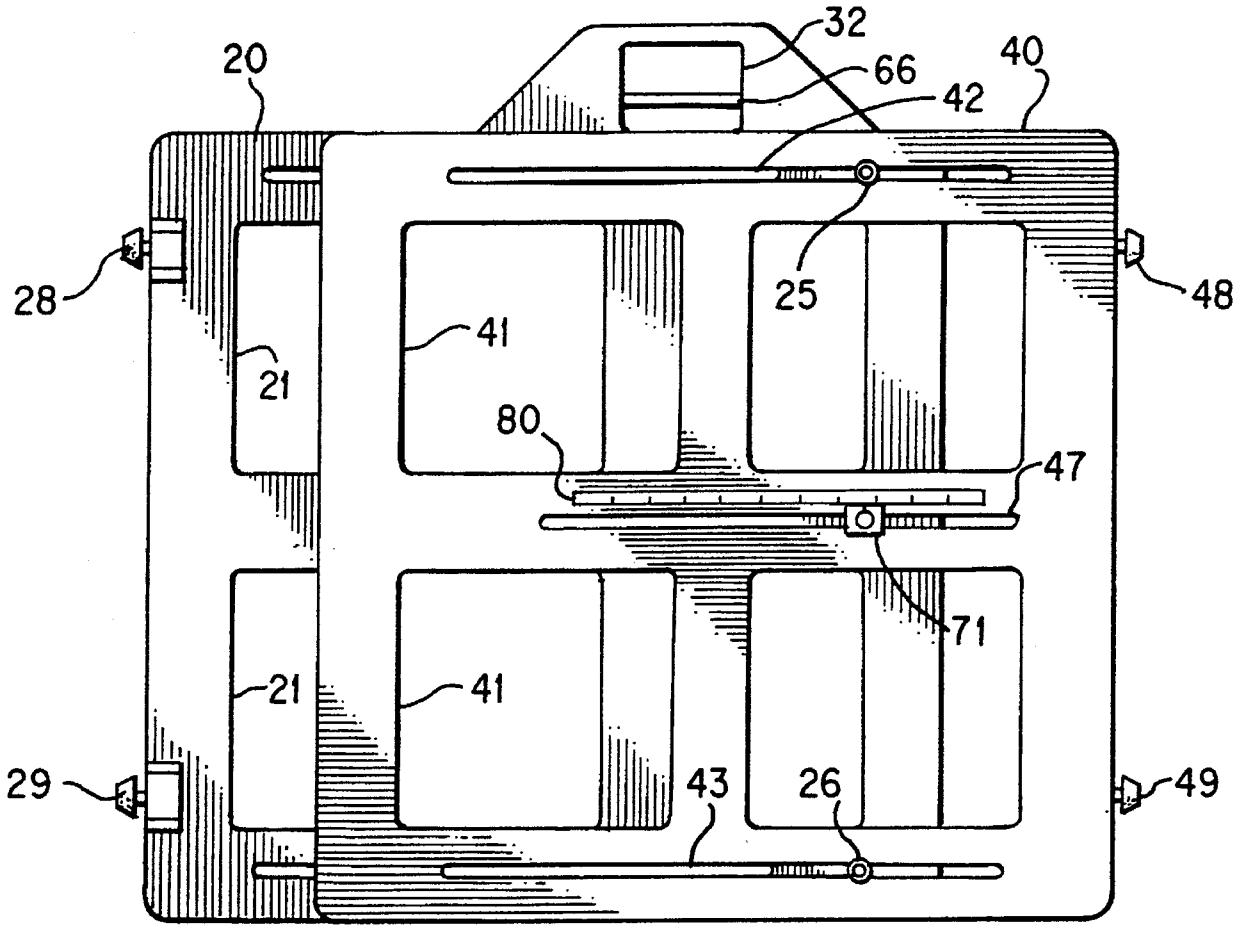
FIG. 1 is a front view of a preferred embodiment of the gate of the present invention.
Figure 2:
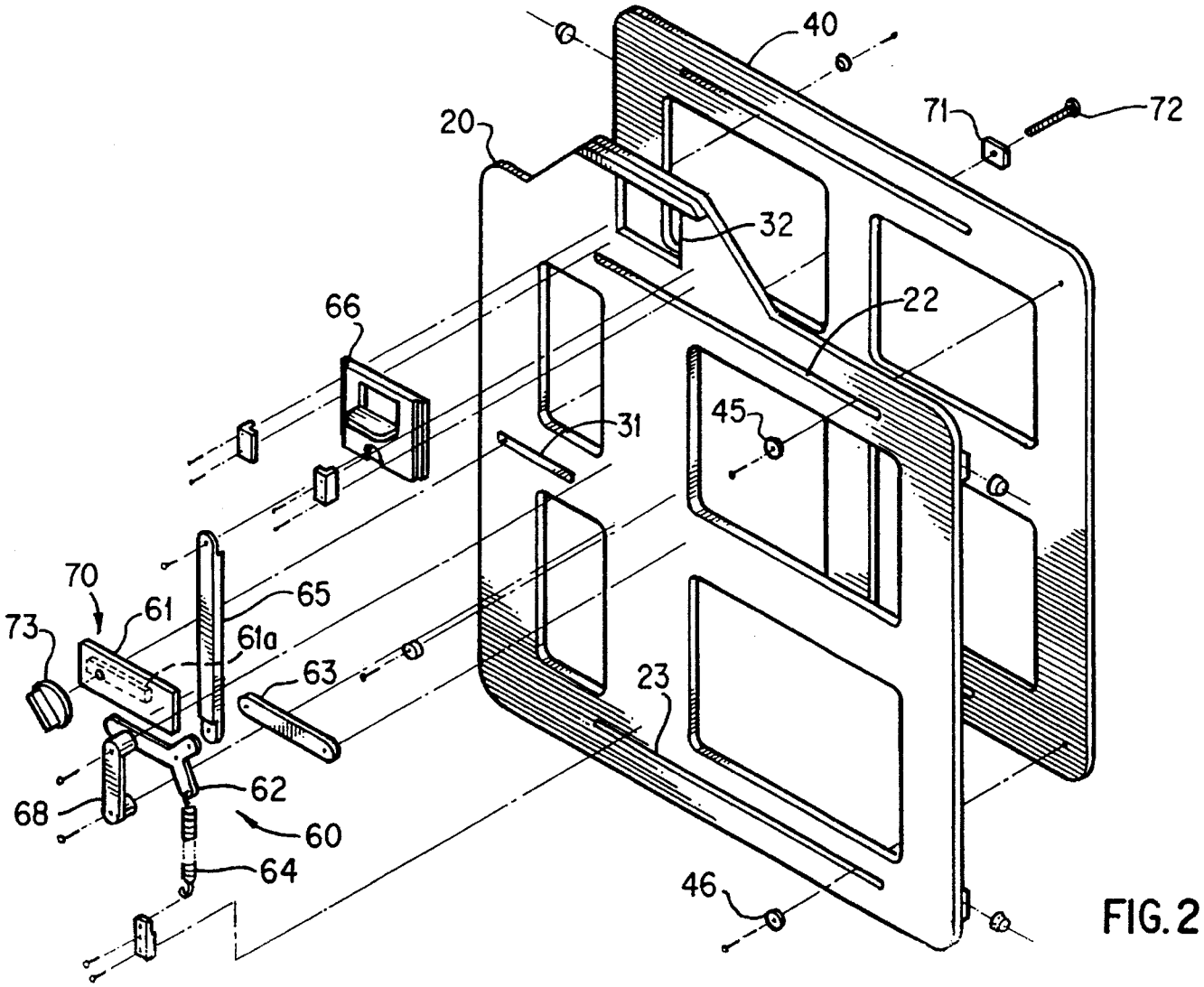
FIG. 2 is an exploded view of the gate.

Reference will now be made in detail to presently preferred embodiments of the invention, examples of which are illustrated in the accompanying drawings. As depicted in FIGS. 1 through 5, the apparatus generally includes a rear panel 20 that is coupled to a partially overlapping front panel 40 so that the panels are slidable laterally relative to each other, thus changing the overall width of the gate. A displacing mechanism is provided by an over-center type toggle linkage 60 that has two ends and is operable via a handle to laterally expand and contract the lateral distance between the ends. One end of the toggle linkage 60 is connected to the rear panel 20, and the other end of the toggle linkage 60 is selectively engagable with the front panel 40 by a releasable engagement mechanism 70.

The engagement mechanism 70 is disengaged or released to permit adjustment of the overall unexpanded width of the gate. When the engagement mechanism 70 is released, the panels 20 and 40 remain freely slidable relative to each other, and permit a range of adjustment of the overall width of the gate apparatus.

Figure 3A:
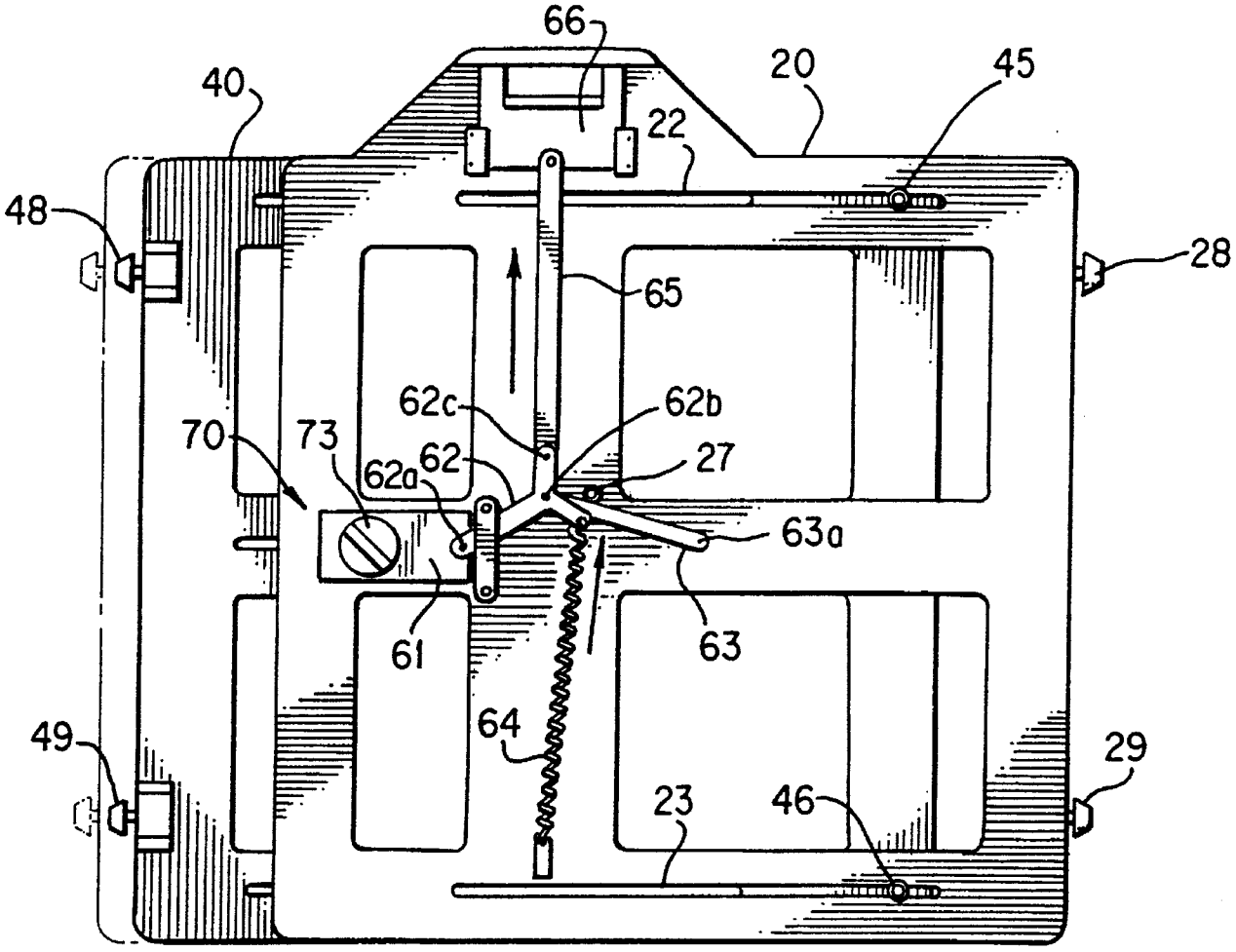
FIG. 3A is a rear view showing the gate with the handle operated and the gate in an unexpanded position.
Figure 3B:
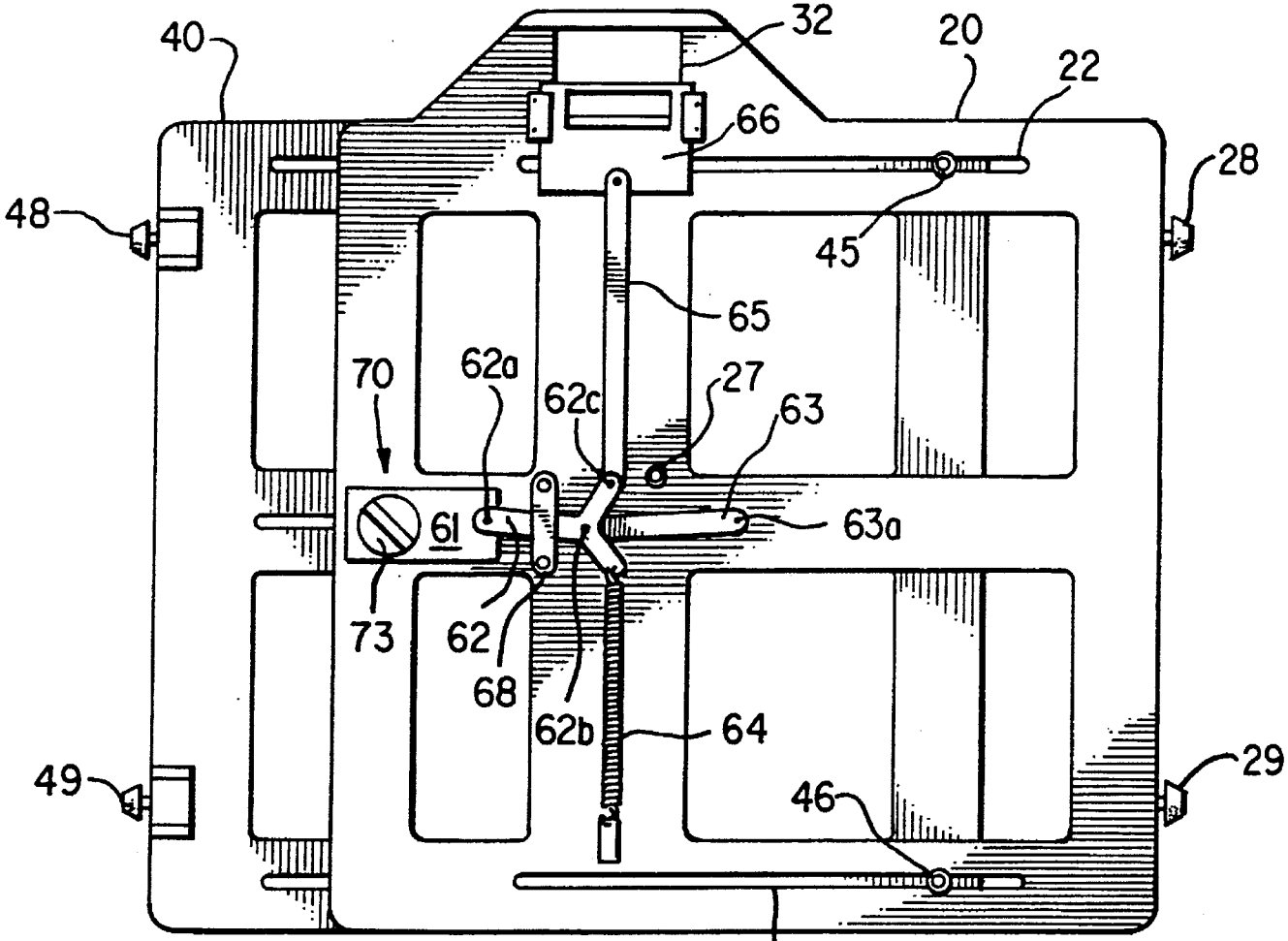
FIG. 3B is a rear view showing the gate with the handle released and the gate in an expanded position.

As best seen in FIGS. 3A and 3B, when the engagement mechanism 70 is engaged, the toggle linkage 60 is operable to displace the rear panel 20 and front panel 40 relative to each other by a predetermined distance to expand the gate and apply an outward lateral force to the sides of an opening to frictionally retain the gate in the opening. This is accomplished because when the engagement mechanism 70 is engaged with the front panel 40, expanding the toggle linkage 60 will laterally displace the panels 20 and 40 relative, to each other, thereby expanding the overall gate width. Conversely, contracting the toggle linkage 60 will displace the panels 20 and 40 relative to each other to reduce the overall gate width.

The preferred embodiment is described in more detail below. As seen in FIG. 3A, the rear panel 20 is slidably coupled to the front panel 40 by sliders 45, 46 attached to the front panel 40 that slide along slots 22, 23 in the rear panel 20. Similarly, as seen in FIG. 1. sliders 25, 26 attached to the rear panel 20 slide in slots 42, 43 in the front panel 40. The rear panel 20 is provided with upper and lower bumpers 28 and 29 which have a rubber or other suitable gripping surface for contacting the side of the opening to be blocked. Similarly, the front panel 40 includes upper and lower bumpers 48 and 49. One or more of these bumpers may be horizontally adjustable to accommodate out-of-square or uneven openings.

In the drawing figures, the rear panel 20 is schematically depicted as a frame shape with openings 21. Similarly, the front panel 40 is schematically depicted as a frame shape with openings 41. In order to provide an effective barrier for infants, children or pets, the openings 21 and 41 are blocked by a mesh or screen or similar blocking material, such as one of the mesh designs known in the art. It will be appreciated that the panels may take any of the many known panel forms such as those suitable for use in security gates used with infants, children or pets. By way of example only, the gate panels may each comprise a rectangular wood perimeter frame with a wire or plastic grid material inside the frame; alternatively, the gate panels may be each comprise integral plastic molded panels.

The engagement mechanism 70 comprises a slider 71 attached by a threaded rod 72 to a knob 73. The rod 72 passes through a slot 47 in the front panel 40 and a slot 31 in the rear panel 20, and also passes through a carriage 61. The rod 72 and slider 71 are capable of sliding along the slot 47 when the knob 73 is loosened. When the knob 73 is tightened, it frictionally engages and locks the front panel 40 between the slider 71 and the carriage 61. However, as discussed below, because of the depth of the protrusion 61*a*, the rear panel 20 is still free to slide laterally relative to the carriage 61. Thus, when the knob 73 is loosened, the panels 20 and 40 are free to slide relative each other, and when the knob 73 is tightened, the slider 71, rod 72, knob 73 and carriage 61 are fixed relative to the front panel 40.

As noted above, the carriage 61 is slidably mounted for lateral motion relative to the rear panel 20 along the slot 31 by a protrusion 61*a* that fits in the slot 31, and is capable of such sliding even when the knob 73 is tightened. The protrusion 61*a* has a depth slightly more than the thickness of the rear panel to permit free lateral sliding of the carriage 61 relative to the rear panel 20.

In the preferred embodiment, an expanding and contracting mechanism is provided by an over-center linkage 60 including links 62 and 63. The link 62 is pivotally connected at one end to carriage 61 by a pin 62*a* and at its other end to the link 63 by a pin 62*b*. The end of the link 63 away from link 62 is pivotally connected to the rear panel 20 by a pin 63*a*. A spring 64 has one end connected to the rear panel 20 and the other end connected to the link 62 near the connection of the links 62 and 63. The spring 64 biases the over-center toggle linkage 60 into the expanded position shown in FIG. 3B. A handle, link 65 is also pivotally connected at one end to the link 62 by a pin 62*c* near the connection of the links 62 and 63 and at its other end is connected to a handle grip 66 that is slidably mounted in a handle opening 32 in the rear panel 20. Squeezing the handle grip 66 raises the handle link 65 and rotates the link 62 upwards against the bias of the spring 64, into the position shown in FIG. 3A so that the link 63 is also rotated as shown, and the over-center linkage 60 is foreshortened laterally—that is the lateral distance between pins 63*a* and 62*a* is reduced. The amount of foreshortening is limited by contact between the link 63 and a post 27 mounted to the rear panel 20.

Since the link 63 is attached to the rear panel 20 by the pin 63*a*, this lateral foreshortening of the over-center linkage moves the carriage 61 laterally inward toward the linkage. If the knob 73 is not tightened, the front panel 40 is not affected and remains free to slide laterally relative to the rear panel 20. However, if the handle grip 66 is squeezed while the knob 73 is tightened, the front panel 40 will be moved inward laterally relative to the rear panel 20 by a distance corresponding to the inward lateral movement of the carriage 61 into the configuration shown in FIG. 3A. Then, releasing the handle grip 66 causes the front panel 40 to move outward laterally relative the rear panel 20 into the configuration shown in FIG. 3B.

Although the expanding and contracting mechanism is described above as an over-center linkage, it will be readily appreciated that other expanding and contracting arrangements may alternatively be employed. By way of example only, a pivoting lever having a pinion that engages teeth on a rack might be employed, with the lever pivotally mounted to the rear panel and the rack connected to the carriage.

The operation of the gate is as follows. Initially, the user places the gate within the opening to be blocked, the rear side facing away from where the child or pet will be enclosed. With the knob 73 loosened and the handle grip 66 squeezed, the panels 20 and 40 are slidably width adjusted so that the width of the gate is equal to or very slightly less than the width of the opening. Next, the knob 73 is fully tightened to set the unexpanded width of the gate. This unexpanded width will remain set the same until the knob 73 is loosened and accordingly can remain the same over several installation and removal procedures of the gate.

An alternative method of setting the unexpanded width is to use a graduated scale 80 printed on the front panel 40 as shown in FIG. 1. The slider 71 may include an indicator line that can be aligned with a measurement on the scale 80 corresponding to, for example, a door opening width, before the knob 73 is tightened.

The gate is then inserted into the opening and the handle grip 66 is released. The spring 64 will urge the toggle linkage 60 so that the carriage 61 is displaced laterally outwardly relative to the rear panel 20. The user may also push down on the top of the handle grip 66 to ensure theft the toggle linkage 60 has been fully extended. Since the slider 71 is in engagement with the front panel 40, the front panel 40 is displaced laterally outwardly relative to the rear panel 20 by a predetermined amount.

As shown in FIG. 3B, the links 62 and 63 rotate slightly over-center after the gate is completely expanded so that it is contracted by a slight amount. That is, the pin **62*b* (the pivot axis of the connection of links 62 and 63 to each other) is located below a line connecting the pins 62*a* and 63*a* (the pivot axes of the connections of links 62 and 63 to the carriage 61 and the rear panel 20, respectively). Due to this over-center rotation the compressive forces on the gate urge the linkage 60 into the locked position—resulting in an additional upward pressure (in addition to the spring bias force) being required on the handle to release the gate, thereby reducing the chances of accidental release of the gate. The amount of over-center travel is limited by contact between the link 62 and a guard member 68 mounted to the rear panel 20**.

When the gate has been expanded inside the opening as described above, it applies an outward lateral force against the sides of the opening. These forces are taken up resiliently in part by compression of the bumpers 28, 29, 48 and 49, and in part by compression and/or minor deflection of the panels 20 and 40.

The gate is released by squeezing the handle grip 66, which pulls upward on the connection of the links 62 and 63 and accordingly also moves the rear panel 20 and the front panel 40 toward each other and releases the pressure on the gate. This permits the gate to be removed form the opening. If the knob 73 is not loosened, the gate will be ready for re-insertion into the same opening. If it is desired to use the gate in a different opening, the knob 73 is loosened, and the overall width adjustment process is begun as described above.

Although the preferred embodiment has been described above in the context of a gate for blocking a doorway opening, it will be readily appreciated that other applications are possible for the invention. For example, the combination of an expansion mechanism and a sliding carriage may be employed with suitable modifications for blocking any opening having side frames such as, for example, a window. Also, although the preferred embodiments are described above, it will be appreciated that various modifications can be made without departing from the scope of the claims.

What is claimed is:

1. A pressure-fit barrier for blocking an opening, comprising:

a first panel;

a second panel slidably coupled to said first panel for lateral movement relative thereto;

a carriage member slidably mounted on said second panel for lateral movement relative to said second panel;

means coupled with said carriage member and said second panel for selectively laterally displacing said carriage relative to said second panel between an expanded and an unexpanded position; and means connected to said carriage for selectively engaging with and non-engaging with said first panel, wherein when said engaging means is non-engaged, lateral movement of said carriage member with respect to said second panel does not cause relative lateral movement between said first panel and said second panel, and when said engaging means is engaged, lateral movement of said carriage member causes corresponding relative lateral movement between said first panel and said second panel.

2. A pressure-fit barrier according to claim 1, further comprising means for biasing said displacing means towards the expanded position.

3. A pressure-fit barrier according to claim 1, further comprising a handle connected to said displacing means for selectively moving said displacing means between the expanded and unexpanded positions.

4. A pressure-fit barrier according to claim 1, wherein said displacing means comprises a linkage having a first end and a second end and is selectively operable between the expanded position in which said ends are separated by a first distance and the contracted position in which said ends are separated by a second distance less than the first distance, said first end of said linkage being pivotally connected to said second panel, and said second end of said linkage being pivotally connected to said carriage, and wherein operation of said linkage between the contracted position and the expanded position causes lateral movement of said carriage relative to said second panel.

5. A pressure-fit barrier according to claim 4, wherein said linkage comprises:

a first lateral link having a first end pivotally connected to said second panel and a second end; and a second lateral link having a third end pivotally connected to said second end of said first lateral link, and a fourth end pivotally connected to said carriage.

6. A pressure-fit barrier according to claim 5, further comprising a spring for biasing said linkage towards the expanded position, said spring extending between said second panel and one of said first and second lateral links.

7. A pressure-fit barrier according to claim 6, further comprising a handle connected to one of said first and second lateral links for selectively moving said linkage towards the unexpanded position.

8. A pressure-fit barrier according to claim 7, wherein said handle is mounted to said second panel and is movable relative thereto.

9. A pressure-fit barrier for blocking an opening, comprising:

a first panel;

a second panel slidably coupled to said first panel for lateral movement relative thereto;

a carriage member slidably mounted on said second panel for lateral movement relative to said second panel; and a linkage having a first end and a second end and selectively operable between an expanded position in which said ends are separated by a first distance and a contracted position in which said ends are separated by a second distance less than the first distance, said first end of said linkage being pivotally connected to said second panel, and said second end of said linkage being pivotally connected to said carriage, wherein operation of said linkage between the contracted position and the expanded position causes lateral movement of said carriage relative to said second panel, wherein said carriage is selectively engagable with and non-engagable with said first panel, wherein when said carriage is non-engaged, lateral movement of said carriage member with respect to said second panel does not cause relative lateral movement between said first panel and said second panel, and when said carriage is engaged, lateral movement of said carriage member causes corresponding relative lateral movement between said first panel and said second panel.

10. A pressure-fit barrier according to claim 9, further comprising means for biasing said linkage towards the expanded position.

11. A pressure-fit barrier according to claim 9, further comprising a handle connected to said linkage for selectively moving said linkage between the expanded and unexpanded positions.

12. A pressure-fit barrier according to claim 9, wherein said linkage comprises:

a first lateral link having a first end pivotally connected to said second panel and a second end; and a second lateral link having a third end pivotally connected to said second end of said first lateral link, and a fourth end pivotally connected to said carriage.

13. A pressure-fit barrier according to claim 12, further comprising a spring for biasing said linkage towards the expanded position, said spring extending between said second panel and one of said first and second lateral links.

14. A pressure-fit barrier according to claim 13, further comprising a handle connected to one of said first and second lateral links for selectively moving said linkage towards the unexpanded position.

15. A pressure-fit barrier according to claim 14, wherein said handle is mounted to said second panel and is movable relative thereto.

16. A pressure-fit barrier for blocking an opening, comprising:

a first panel;

a second panel slidably coupled to said first panel for lateral movement relative thereto;

a carriage member slidably mounted on said second panel for lateral movement relative to said second panel;

a linkage having a first end and a second end and is selectively operable between an expanded position in which said ends are separated by a first distance and a contracted position in which said ends are separated by a second distance less than the first distance, said first end of said linkage being pivotally connected to said second panel, and said second end of said linkage being pivotally connected to said carriage, wherein operation of said linkage between the contracted position and the expanded position causes lateral movement of said carriage relative to said second panel;

a sliding member capable of frictional engagement with said second panel when urged against said second panel; and a knob having a threaded coupling to said sliding member, wherein said carriage member and said second panel are sandwiched between said knob and said sliding member so that said knob, said carriage, and said sliding member remain fixed laterally together relative to one another, and wherein rotation of said knob into an engaging position urges said sliding member into frictional engagement with said second panel, and rotation of said knob into a non-engaging position releases said sliding member from engagement with said second panel;

wherein said carriage is selectively engagable with and non-engagable with said first panel so that when said sliding member is non-engaged, lateral movement of said carriage member with respect to said second panel does not cause relative lateral movement between said first panel and said second panel, and when said sliding member is engaged, lateral movement of said carriage member causes corresponding relative lateral movement between said first panel and said second panel.

* * * * *